US010223989B2

(12) United States Patent
Lu et al.

(10) Patent No.: US 10,223,989 B2
(45) Date of Patent: Mar. 5, 2019

(54) DRIVING METHOD OF LIQUID CRYSTAL DISPLAY PANEL

(71) Applicant: Wuhan China Star Optoelectronics Technology Co., Ltd., Wuhan, Hubei (CN)

(72) Inventors: Yucheng Lu, Guangdong (CN); Chun-hung Huang, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 137 days.

(21) Appl. No.: 15/526,732

(22) PCT Filed: Mar. 18, 2017

(86) PCT No.: PCT/CN2017/077161

§ 371 (c)(1),
(2) Date: May 12, 2017

(87) PCT Pub. No.: WO2018/152905

PCT Pub. Date: Aug. 30, 2018

(65) Prior Publication Data

US 2018/0286331 A1 Oct. 4, 2018

(30) Foreign Application Priority Data

Feb. 27, 2017 (CN) ..... 2017 1 0109614

(51) Int. Cl.
*G09G 3/36* (2006.01)

(52) U.S. Cl.
CPC ..... *G09G 3/3614* (2013.01); *G09G 3/36* (2013.01); *G09G 3/3677* (2013.01);
(Continued)

(58) Field of Classification Search
CPC ..... G09G 3/3614; G09G 2300/0823; G09G 2310/0254
See application file for complete search history.

(56) References Cited

U.S. PATENT DOCUMENTS 6,496,172 B1 * 12/2002 Hirakata ..... G09G 3/3614 345/100
7,259,755 B1 * 8/2007 Ahn ..... G09G 3/3614 345/204

(Continued)

FOREIGN PATENT DOCUMENTS

CN 101923839 A 12/2010
CN 102884475 A 1/2013

(Continued)

*Primary Examiner* — Kevin M Nguyen
(74) *Attorney, Agent, or Firm* — Andrew C. Cheng

(57) ABSTRACT

Provided is a driving method of a liquid crystal display panel, comprising: inputting an activation voltage to the scan lines from a first direction in a first duration, and inputting a pixel voltage of a first polarity to the data lines to charge the pixel capacitors; inputting an activation voltage to the scan lines from the first direction in a second duration, and inputting a pixel voltage of a second polarity to the data lines to charge the pixel capacitors; inputting an activation voltage to the scan lines from a second direction in a third duration, and inputting the pixel voltage of the first polarity to the data lines to charge the pixel capacitors; inputting an activation voltage to the scan lines from the second direction in a fourth duration, and inputting the pixel voltage of the second polarity to the data lines to charge the pixel capacitors.

10 Claims, 3 Drawing Sheets

(52) U.S. Cl.
CPC ..... *G09G 3/3688* (2013.01); *G09G 2310/08* (2013.01); *G09G 2320/0214* (2013.01); *G09G 2320/0233* (2013.01); *G09G 2320/0626* (2013.01)

(56) References Cited

U.S. PATENT DOCUMENTS

| | | | | |
|---|---|---|---|---|
| 9,762,191 | B1 * | 9/2017 | Chen | H03F 3/213 |
| 2005/0168425 | A1 * | 8/2005 | Takada | G09G 3/2051 345/94 |

FOREIGN PATENT DOCUMENTS

| | | | |
|---|---|---|---|
| CN | 104714319 | A | 6/2015 |
| CN | 105047115 | A | 11/2015 |
| CN | 105511184 | A | 4/2016 |
| JP | 2001209027 | A | 8/2001 |

* cited by examiner

DRIVING METHOD OF LIQUID CRYSTAL DISPLAY PANEL

CROSS REFERENCE

This application claims the priority of Chinese Patent Application No. 201710109614.7, entitled "Driving method of liquid crystal display panel", filed on Feb. 27, 2017, the disclosure of which is incorporated herein by reference in its entirety.

FIELD OF THE INVENTION

The present invention relates to a display technology field, and more particularly to a driving method of a liquid crystal display panel.

BACKGROUND OF THE INVENTION

The liquid crystal display panel according to prior art comprises a gate driver, N scan lines, a source driver, M data lines, a plurality of thin film transistors, a plurality of pixel capacitors, wherein N, M≥2, and the pixel capacitor comprises a pixel electrode, a common electrode and a liquid crystal layer between the pixel electrode and the common electrode.

In case that the liquid crystals in the liquid crystal layer is driven by the electric field of the same direction in a long period of time, for instance, the pixel electrode is constantly to have positive polarity, the polarization may easily generate to the liquid crystals, and eventually it leads to that the liquid crystals cannot be normally twisted in the electric field. For preventing the polarization of the liquid crystals, in the driving process of the liquid crystals, the voltage outputted to the liquid crystal capacitor by the data line generally performs polarity inversion with time to avoid the polarization in condition that the twisted angle of the liquid crystals are not changed. For the entire liquid crystal display panel, the most common polarity inversions in the industry are column inversion and frame inversion.

For avoiding the mischarge of the data line and the leakage of the liquid crystal capacitor, as the data line of some row applies the activation voltage to activate the thin film transistors for charging the corresponding liquid crystal capacitors, the scan lines of other rows need to be applied with the negative voltage for better deactivating the thin film transistors. However, as the pixel capacitors of the same column or all the pixel capacitors in the previous frame have positive polarity, the pixel capacitors of the column or all the pixel capacitors in the present frame need to perform polarity inversion to have negative polarity. However, the scan lines coupled to the pixel capacitors, which are not charged, are applied with a negative voltage, and then the data lines needs to input the negative voltage to the corresponding pixel capacitor for charging to lead to that the voltage difference of the gate and source of the thin film transistor coupled to the pixel capacitor, which is not charged, decreases and to result in the increase of the leakage current of the thin film transistor. Because the scan lines perform scan from the top to the bottom, the leakage durations of the pixel capacitors coupled to the second scan line to the pixel capacitors coupled to the last scan line gradually increase, and the brightnesses gradually decrease, and eventually, the brightnesses of the images at the upper side and the lower side of the liquid crystal display panel are not uniform.

SUMMARY OF THE INVENTION

The technical issue that the embodiment of the present invention solves is to provide a driving method of a liquid crystal display panel. The issue of the brightness unevenness of the liquid crystal display panel can be reduced.

For solving the aforesaid technical issue, the present invention provides a driving method of a liquid crystal display panel, and the liquid crystal display panel comprising a gate driver, N scan lines, a source driver, M data lines, a plurality of pixel capacitors, wherein N, M≥2, wherein the driving method comprises:

the gate driver inputting an activation voltage to the scan lines line by line from a first direction in a first duration, and the source driver inputting a pixel voltage of a first polarity to the data lines to charge the pixel capacitors;

the gate driver inputting an activation voltage to the scan lines line by line from the first direction in a second duration, and the source driver inputting a pixel voltage of a second polarity to the data lines to charge the pixel capacitors;

the gate driver inputting an activation voltage to the scan lines line by line from a second direction in a third duration, and the source driver inputting the pixel voltage of the first polarity to the data lines to charge the pixel capacitors;

the gate driver inputting an activation voltage to the scan lines line by line from the second direction in a fourth duration, and the source driver inputting the pixel voltage of the second polarity to the data lines to charge the pixel capacitors; wherein the pixel capacitors of the same column have the same polarity in the same duration, and the first polarity and the second polarity are opposite, and the second direction and the first direction are opposite.

The first duration, the second duration, the third duration and the fourth duration construct one drive cycle of the liquid crystal display panel.

The first duration, the second duration, the third duration and the fourth duration are arranged in time sequence; or the third duration, the fourth duration, the first duration and the second duration are arranged in time sequence.

A fifth duration is after the first duration, and in the fifth duration, the gate driver and the source driver perform the same operation according to the first duration; a sixth duration is after the second duration, and in the sixth duration, the gate driver and the source driver perform the same operation according to the second duration; a seventh duration is after the third duration, and in the seventh duration, the gate driver and the source driver perform the same operation according to the third duration; an eighth duration is after the fourth duration, and in the eighth duration, the gate driver and the source driver perform the same operation according to the fourth duration.

The first duration to the eighth duration construct one drive cycle of the liquid crystal display panel.

2k durations are after the second duration, and 2j durations are after the fourth duration, and in two adjacent durations of the 2k durations, the gate driver and the source driver perform the same operation according to the first duration and the second duration, and in two adjacent durations of the 2j durations, the gate driver and the source driver perform the same operation according to the third duration and the fourth duration, wherein k and j are equal, and k and j are positive integers.

The first duration, the second duration, the third duration and the fourth duration individually are one frame.

The first direction is a direction from the top to the bottom, and the second direction is a direction from the bottom to the top; or, the first direction is a direction from the bottom to the top, and the second direction is a direction from the top to the bottom.

The first polarity is a positive polarity, and the second polarity is a negative polarity; or, the first polarity is a negative polarity, and the second polarity is a positive polarity.

A polarity inversion of the pixel capacitors is a row inversion or a frame inversion.

With implementing the embodiments of the present invention, the benefits are: because the pixel capacitors of the same column have the same polarity in the same duration, and the first polarity and the second polarity are opposite, and the second direction and the first direction are opposite, the brightnesses of the liquid crystal display panel in the third duration and in the fourth duration can compensate the brightnesses of the liquid crystal display panel in the first duration and in the second duration, which is beneficial to make the brightness of the entire liquid crystal display panel more even and promote the display effect of the images.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Furthermore, the terms "including" and "having" and their any deformations are intended to cover non-exclusive inclusion. For example, a process, a method, a system, a product or a device comprising a series of steps or units which is not limited to the steps or units already listed, but optionally further comprises steps or units which are not listed, or optionally further comprises other steps or units which are inherent in these the process, the method, the product or the device. The terminologies "first", "second" and "third" are used for distinguishing different objects but not for describing the specific sequence.

Figure 1:
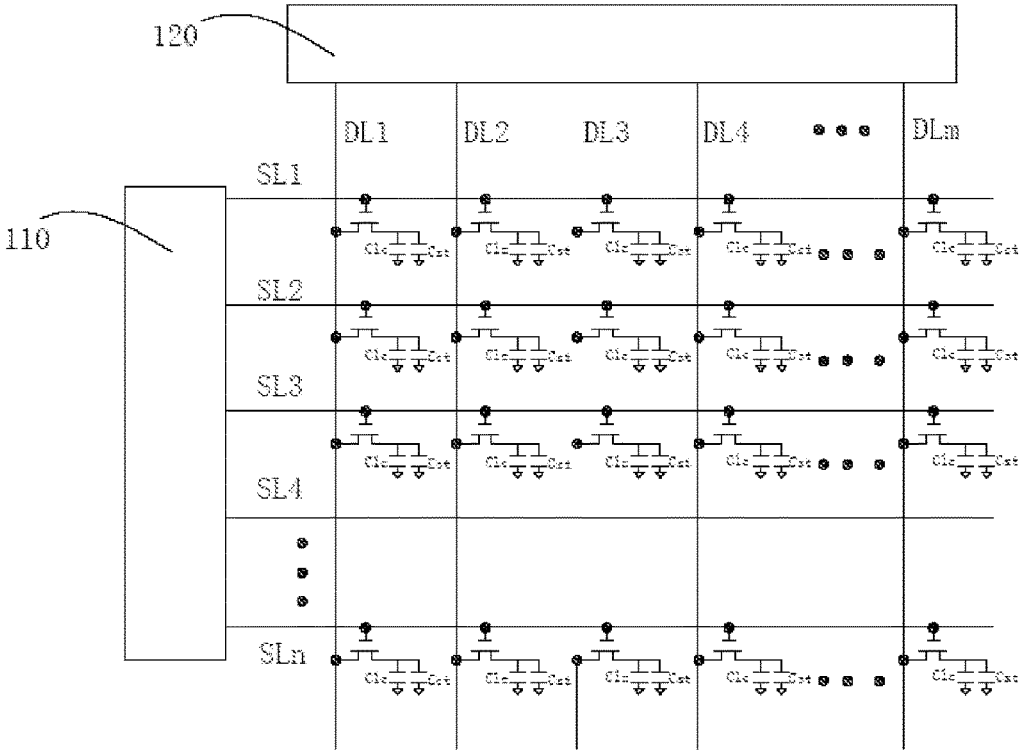
FIG. 1 is a circuit diagram of a liquid crystal display panel of the present invention.
Figure 2:
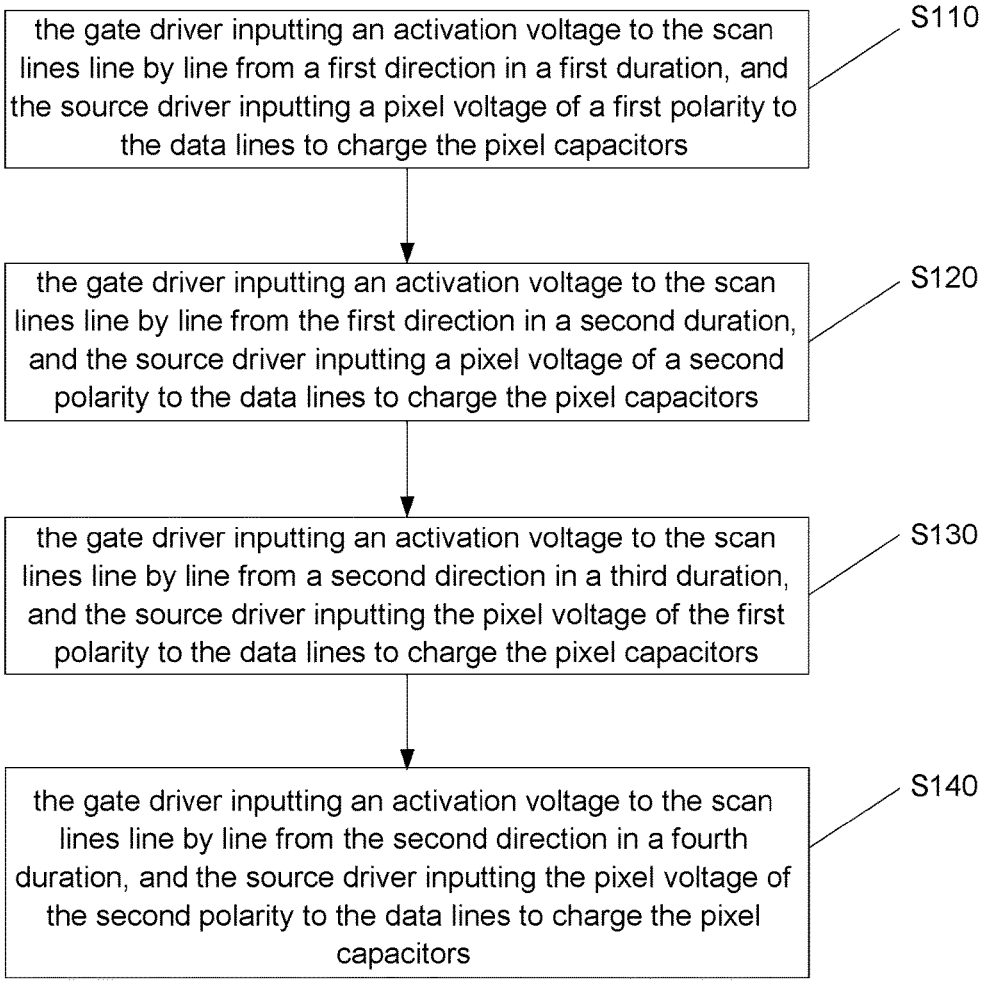
FIG. 2 is a flowchart of a driving method of a liquid crystal display panel according to one embodiment of the present invention.

The present invention provides a driving method of a liquid crystal display panel. Please refer to FIG. 1. The liquid crystal display panel comprises a gate driver 110, N scan lines SL1-SLn, a source driver 120, M data lines DL1-DLm, a plurality of pixel capacitors Clc, wherein N, M≥2, wherein one ends of the N scan lines SL1-SLn are electrically coupled to the gate driver 110 to receive voltage signals sent by the gate driver 110, and one ends of the M data lines DL1-DLm are electrically coupled to the source driver 120 to receive voltage signals sent by the source driver 120, and the N scan lines SL1-SLn and the M data lines DL1-DLm intersect and form a plurality of pixel regions, and an amount of the pixel regions is N*M, and each pixel region comprises a thin film transistor and a pixel electrode, and a gate of the thin film transistor is electrically coupled to the corresponding scan line SL, and a source of the thin film transistor is electrically coupled to the corresponding data line DL, and a drain of the thin film transistor is electrically coupled to the corresponding pixel electrode, and the pixel electrode and a common electrode and a liquid crystal layer of the liquid crystal display panel construct a pixel capacitor Clc, and the liquid crystal layer is between the pixel electrode and the common electrode. For preventing the polarization of the liquid crystals, the polarity inversions in this embodiment are column inversion and frame inversion. Certainly, in other embodiments of the present invention, other polarity inversions also can be illustrated. Specifically, the column inversion means that the polarities of the pixel capacitors Clc of the same column are different in two adjacent frames. For instance, the polarities of the pixel capacitors Clc of the first column in the first frame are positive, and the polarities in the second frame are negative, and the polarities in the third frame are positive, and the polarities in the fourth frame are negative . . . ; the frame inversion means that the polarities of all the pixels are different in the two adjacent frames, and the polarities of all the pixels in the same frame are the same. For instance, the polarities of all the pixel capacitors Clc of the first frame are positive, and the polarities in the second frame are negative, and the polarities in the third frame are positive, and the polarities in the fourth frame are negative . . . . For convenience, the column inversion is illustrated for description. Please refer to FIG. 2. The drive method comprises steps of:

S110: the gate driver 110 inputting an activation voltage to the scan lines line by line from a first direction in a first duration, and the source driver 120 inputting a pixel voltage of a first polarity to the data lines DL to charge the pixel capacitors Clc.

In this embodiment, the first duration is a period of one frame.

In this embodiment, the first direction is a direction from the top to the bottom, and the gate driver 110 inputs an activation voltage to the scan lines line by line from the top to the bottom. Namely, the gate driver 110 first inputs the activation voltage to the first scan line SL1, and then the thin film transistors coupled with the first scan line SL1 are activated, and thus the voltage inputted through the data line DL charges the liquid crystal capacitors coupled to the first scan line SL1. After charging a period of time, the gate driver 110 inputs a deactivation voltage to the first scan line SL1. For preventing the larger leakage current, the deactivation voltage is a negative voltage; then, the gate driver 110 inputs the activation voltage to the second scan line SL2, and thus the voltage inputted through the data line DL charges the liquid crystal capacitors coupled to the second scan line SL2. After charging a period of time, the gate driver 110 inputs the deactivation voltage to the second scan line SL2. Similarly, the deactivation voltage is a negative voltage; and then, the gate driver 110 inputs the activation voltage to the third scan line, the fourth scan line, the fifth scan line . . . , the n−1th scan line SLn-1; at last, the gate driver 110 inputs the activation voltage to the nth scan line SLn, and thus the voltage inputted through the data line DL charges the liquid crystal capacitors coupled to the nth scan line SLn. After charging a period of time, the gate driver 110 inputs the deactivation voltage to the nth scan line SLn. Similarly, the deactivation voltage is a negative voltage. At this point, the gate driver 110 accomplishes the operation of inputting the activation voltage to the scan lines line by line from the first direction, and the all of the pixel capacitors Clc accomplish the charging operations. Certainly, the first direction of the present invention can not only be limited to the direction from the top to the bottom but the first direction also can be a direction from the bottom to the top. Namely, the gate driver 110 first inputs the activation voltage to the nth scan line SLn, and then the gate driver 110 inputs the activation voltage to the n−1th scan line SLn-1, and then the gate driver 110 inputs the activation voltage to the n−1th scan line, . . . , and at last, the gate driver 110 inputs the activation voltage to the first scan line. Certainly, in other embodiments of the present invention, the first direction is not limited to the aforesaid direction which is simpler but also a scan from one scan line in the middle to the two sides also can be illustrated.

When the gate driver 110 inputs the activation voltage to one scan line, the thin film transistor coupled to the scan line is activated, and the source driver 120 inputs a pixel voltage of the first polarity to the data line DL. Then, the pixel voltage on the data line DL is inputted into the pixel capacitor Clc, and thus to charge the pixel capacitor Clc. In this embodiment, the polarities of the pixel voltages inputted to the pixel capacitors Clc of different columns are different. Namely, the first polarities of the pixel voltages of different columns are different. For instance, the pixel voltage inputted to the pixel capacitors Clc of the first column has a positive polarity, and the pixel voltage inputted to the pixel capacitors Clc of the second column has a negative polarity, and the pixel voltage inputted to the pixel capacitors Clc of the third column has a positive polarity, and the pixel voltage inputted to the pixel capacitors Clc of the fourth column has a negative polarity, . . . , and the pixel voltage inputted to the pixel capacitors Clc of the Mth column has a positive polarity. In this embodiment, the data lines DL input the voltages in a forward direction. Namely, for the image shown in the first duration, the data lines DL first input the pixel voltages corresponding to the image at the upper side of the liquid crystal display panel, and then input the pixel voltages corresponding to the image in the middle of the liquid crystal display panel, and at last, input the pixel voltages corresponding to the image at the lower side of the liquid crystal display panel.

S120: the gate driver 110 inputting an activation voltage to the scan lines line by line from the first direction in a second duration, and the source driver 120 inputting a pixel voltage of a second polarity to the data lines DL to charge the pixel capacitors Clc.

In this embodiment, the second duration is a period of one frame.

In this embodiment, as the same as the first duration, the gate driver 110 inputs the activation voltage to the scan lines line by line from the top to the bottom. The source driver 120 inputs the pixel voltage of the second polarity to the data lines DL. At this point, the second polarity and the first polarity are opposite. Namely, as the pixel voltage inputted to one pixel capacitor Clc in the first duration has the positive polarity, the pixel voltage relative to the voltage of the common electrode, which is inputted to the pixel capacitor Clc in the second duration, has the negative polarity to avoid the polarization of the liquid crystals. In this embodiment, the second polarities of the pixel voltages inputted to the pixel capacitors Clc of different columns are different. For instance, the pixel voltage inputted to the pixel capacitors Clc of the first column has negative polarity, and the pixel voltage inputted to the pixel capacitors Clc of the second column has positive polarity, and the pixel voltage inputted to the pixel capacitors Clc of the third column has negative polarity, and the pixel voltage inputted to the pixel capacitors Clc of the fourth column has positive polarity, . . . , and the pixel voltage inputted to the pixel capacitors Clc of the Mth column has negative polarity.

In this embodiment, as the pixel capacitors Clc of one column corresponded with one data line DL have positive polarity in the first duration, the pixel capacitors Clc corresponded with the data line DL inputted by the source driver 120 have negative polarity in the second duration, and in the beginning of the second duration, while the gate driver 110 inputs the activation voltage to the first scan line SL1, the gate driver 110 inputs the deactivation voltage to the second scan line to the nth scan line SLn, and the deactivation voltage is a negative voltage, and the pixel voltage relative to the voltage of the common electrode, which is transmitted by the data line DL corresponding to the pixels of the column is a negative voltage to charge the first pixel capacitor Clc of the pixel capacitors Clc of the column, and because the voltage difference of the gate and source of the thin film transistor decreases, the leakages of the second pixel capacitor to the Nth pixel capacitor of the pixel capacitors Clc of the column increase, and as the first scan line SL1 is deactivated, the first pixel capacitor Clc of the pixel capacitors Clc of the column accomplishes charging, and the polarity is negative, and the second pixel capacitor Clc to the Nth pixel capacitor Clc of the pixel capacitors Clc of the column leak for an activation duration of one scan line; then, as the gate driver 110 inputs the activation voltage to the second scan line, the gate driver 110 inputs the deactivation voltage to the first scan line SL1, the third scan line to the nth scan line SLn, and the deactivation voltage is a negative voltage, and the pixel voltage relative to the voltage of the common electrode, which is transmitted by the data line DL corresponding to the pixels of the column is a negative voltage to charge the second pixel capacitor Clc of the pixel capacitors Clc of the column, and because the voltage difference of the gate and source of the thin film transistor decreases, the leakages of the third pixel capacitor to the Nth pixel capacitor of the pixel capacitors Clc of the column increase, and as the second scan line SL2 is deactivated, the second pixel capacitor Clc of the pixel capacitors Clc of the column accomplishes charging, and the polarity is negative, and the third pixel capacitor Clc to the Nth pixel capacitor of the pixel capacitors Clc of the column leak for an activation duration of one scan line; . . . ; and then, as the gate driver 110 inputs the activation voltage to the n−1th scan line SLn-1, the gate driver 110 inputs the deactivation voltage to the first scan line SL1 to the n−2th scan line SLn-2, and the deactivation voltage is a negative voltage, and the pixel voltage relative to the voltage of the common electrode, which is transmitted by the data line DL corresponding to the pixels of the column is a negative voltage to charge the N−1th pixel capacitor Clc of the pixel capacitors Clc of the column, and because the voltage difference of the gate and source of the thin film transistor decreases, the leakage of the Nth pixel capacitor of the pixel capacitors Clc of the column increases, and as the n−1th scan line SLn-1 is deactivated, the N−1th pixel capacitor Clc of the pixel capacitors Clc of the column accomplishes charging, and the polarity is negative, and the Nth pixel capacitor of the pixel capacitors Clc of the column leaks for an activation duration of one scan line; at last, as the gate driver 110 inputs the activation voltage to the nth scan line SLn, the gate driver 110 inputs the deactivation voltage to the first scan line SL1 to the n−1th scan line SLn-1, and the pixel voltage relative to the voltage of the common electrode, which is transmitted by the data line DL corresponding to the pixels of the column is a negative voltage to charge the Nth pixel capacitor Clc of the pixel capacitors Clc of the column, and as the nth scan line SLn is deactivated, the N−1th pixel capacitor Clc of the pixel capacitors Clc of the column accomplishes charging, and the polarity is negative. Accordingly, the first pixel capacitor Clc of the pixel capacitors of the column will not leak or the leakage is smaller, and the second pixel capacitor Clc leaks for one charging duration, and the third pixel capacitor Clc leaks for two charging durations, . . . , the N−1th pixel capacitor Clc leaks N−2 charging durations, and the Nth pixel capacitor Clc leaks N−1 charging durations, and the pixel capacitors of other columns have the similarity to lead to that the brightness of the liquid crystal display panel is darkened from the top to the bottom in the second duration.

S130: the gate driver 110 inputting an activation voltage to the scan lines line by line from a second direction in a third duration, and the source driver 120 inputting the pixel voltage of the first polarity to the data lines DL to charge the pixel capacitors Clc.

In this embodiment, the third duration is a period of one frame.

The second direction and the first direction are opposite. In this embodiment, the second direction is a direction from the bottom to the top, and the gate driver 110 inputs an activation voltage to the scan lines line by line from the bottom to the top. Namely, the gate driver 110 first inputs the activation voltage to the nth scan line SLn, and then the thin film transistors coupled with the nth scan line SLn are activated, and thus the voltage inputted through the data line DL charges the liquid crystal capacitors coupled to the nth scan line SLn. After charging a period of time, the gate driver 110 inputs a deactivation voltage to the nth scan line SLn. For preventing the larger leakage current, the deactivation voltage is a negative voltage; then, the gate driver 110 inputs the activation voltage to the n−1th scan line SLn-1, and thus the voltage inputted through the data line DL charges the liquid crystal capacitors coupled to the n−1th scan line SLn-1. After charging a period of time, the gate driver 110 inputs the deactivation voltage to the n−1th scan line SLn-1. Similarly, the deactivation voltage is a negative voltage; and then, the gate driver 110 inputs the activation voltage to the n−2th scan line, the n−3th scan line, the n−4th scan line . . . , the second scan line SL2; at last, the gate driver 110 inputs the activation voltage to the first scan line SL1, and thus the voltage inputted through the data line DL charges the liquid crystal capacitors coupled to the first scan line SL1. After charging a period of time, the gate driver 110 inputs the deactivation voltage to the first scan line SL1. Similarly, the deactivation voltage is a negative voltage. At this point, the gate driver 110 accomplishes the operation of inputting the activation voltage to the scan lines line by line, and the all of the pixel capacitors Clc accomplish the charging operations.

When the gate driver 110 inputs the activation voltage to one scan line, the thin film transistor coupled to the scan line is activated, and the source driver 120 inputs a pixel voltage to the data line DL. Then, the pixel voltage on the data line DL is inputted into the pixel capacitor Clc, and thus to charge the pixel capacitor Clc. In this embodiment, the polarities of the pixel voltages inputted to the pixel capacitors Clc of different columns are different. Namely, the first polarities of the pixel voltages of different columns are different. For instance, the pixel voltage inputted to the pixel capacitors Clc of the first column has a positive polarity, and the pixel voltage inputted to the pixel capacitors Clc of the second column has a negative polarity, and the pixel voltage inputted to the pixel capacitors Clc of the third column has a positive polarity, and the pixel voltage inputted to the pixel capacitors Clc of the fourth column has a negative polarity, . . . , and the pixel voltage inputted to the pixel capacitors Clc of the Mth column has a positive polarity. In this embodiment, the data lines DL input the voltages in a backward direction. Namely, for the image shown in the third duration, the data lines DL first input the pixel voltages corresponding to the image at the upper side of the liquid crystal display panel, and then input the pixel voltages corresponding to the image in the middle of the liquid crystal display panel, and at last, input the pixel voltages corresponding to the image at the lower side of the liquid crystal display panel.

S140: the gate driver 110 inputting an activation voltage to the scan lines line by line from the second direction in a fourth duration, and the source driver 120 inputting the pixel voltage of the second polarity to the data lines DL to charge the pixel capacitors Clc.

In this embodiment, the fourth duration is a period of one frame.

In this embodiment, as the same as the third duration, the gate driver 110 inputs the activation voltage to the scan lines line by line from the bottom to the top. The source driver 120 inputs the pixel voltage of the second polarity to the data lines DL. At this point, the second polarity and the first polarity are opposite. Namely, as the pixel voltage inputted to one pixel capacitor Clc in the third duration has the positive polarity, the pixel voltage, which is inputted to the pixel capacitor Clc in the fourth duration, has the negative polarity to avoid the polarization of the liquid crystals. In this embodiment, the second polarities of the pixel voltages inputted to the pixel capacitors Clc of different columns are different. For instance, the pixel voltage inputted to the pixel capacitors Clc of the first column has negative polarity, and the pixel voltage inputted to the pixel capacitors Clc of the second column has positive polarity, and the pixel voltage inputted to the pixel capacitors Clc of the third column has negative polarity, and the pixel voltage inputted to the pixel capacitors Clc of the fourth column has positive polarity, . . . , and the pixel voltage inputted to the pixel capacitors Clc of the Mth column has negative polarity.

In this embodiment, as the pixel capacitors Clc of one column corresponded with one data line DL have positive polarity in the third duration, the pixel capacitors Clc corresponded with the data line DL inputted by the source driver 120 have negative polarity in the fourth duration, and in the beginning of the fourth duration, while the gate driver 110 inputs the activation voltage to the nth scan line SLn, the gate driver 110 inputs the deactivation voltage to the first scan line to the n−1th scan line, and the deactivation voltage is a negative voltage, and the pixel voltage relative to the voltage of the common electrode, which is transmitted by the data line DL corresponding to the pixels of the column is a negative voltage to charge the Nth pixel capacitor Clc of the pixel capacitors Clc of the column, and because the voltage difference of the gate and source of the thin film transistor decreases, the leakages of the first pixel capacitor to the N−1th pixel capacitor of the pixel capacitors Clc of the column increase, and as the nth scan line SLn is deactivated, the Nth pixel capacitor Clc of the pixel capacitors Clc of the column accomplishes charging, and the polarity is negative, and the first pixel capacitor Clc to the N−1th pixel capacitor Clc of the pixel capacitors Clc of the column leak for an activation duration of one scan line; then, as the gate driver 110 inputs the activation voltage to the n−1th scan line SLn-1, the gate driver 110 inputs the deactivation voltage to the first scan line SL1 to the n−2th scan line SLn-2 and the nth scan line SLn, and the deactivation voltage is a negative voltage, and the pixel voltage relative to the voltage of the common electrode, which is transmitted by the data line DL corresponding to the pixels of the column is a negative voltage to charge the N−1th pixel capacitor Clc of the pixel capacitors Clc of the column, and because the voltage difference of the gate and source of the thin film transistor decreases, the leakages of the first pixel capacitor to the N−2th pixel capacitor of the pixel capacitors Clc of the column increase, and as the n−1th scan line SLn-1 is deactivated, the N−1th pixel capacitor Clc of the pixel capacitors Clc of the column accomplishes charging, and the polarity is negative, and the first pixel capacitor Clc to the N−2th pixel capacitor of the pixel capacitors Clc of the column leak for an activation duration of one scan line; . . . ; and then, as the gate driver 110 inputs the activation voltage to the second scan line SL2, the gate driver 110 inputs the deactivation voltage to the first scan line SL1, the third scan line to the nth scan line SLn, and the deactivation voltage is a negative voltage, and the pixel voltage relative to the voltage of the common electrode, which is transmitted by the data line DL corresponding to the pixels of the column is a negative voltage to charge the second pixel capacitor Clc of the pixel capacitors Clc of the column, and because the voltage difference of the gate and source of the thin film transistor decreases, the leakage of the first pixel capacitor of the pixel capacitors Clc of the column increases, and as the second scan line SL2 is deactivated, the second pixel capacitor Clc of the pixel capacitors Clc of the column accomplishes charging, and the polarity is negative, and the first pixel capacitor of the pixel capacitors Clc of the column leaks for an activation duration of one scan line; at last, as the gate driver 110 inputs the activation voltage to the first scan line SL1, the gate driver 110 inputs the deactivation voltage to the second scan line SL2 to the nth scan line SLn, and the pixel voltage relative to the voltage of the common electrode, which is transmitted by the data line DL corresponding to the pixels of the column is a negative voltage to charge the first pixel capacitor Clc of the pixel capacitors Clc of the column, and as the first scan line SL1 is deactivated, the first pixel capacitor Clc of the pixel capacitors Clc of the column accomplishes charging, and the polarity is negative. Accordingly, the Nth pixel capacitor Clc of the pixel capacitors of the column will not leak or the leakage is smaller, and the N−1th pixel capacitor Clc leaks for one charging duration, and the N−2th pixel capacitor Clc leaks for two charging durations, . . . , the second pixel capacitor Clc leaks N−2 charging durations, and the first pixel capacitor Clc leaks N−1 charging durations, and the pixel capacitors of other columns have the similarity to lead to that the brightness of the liquid crystal display panel is darkened from the bottom to the top in the fourth duration. Accordingly, the fourth duration can compensate the second duration to achieve that the leakage times of the pixel capacitors Clc of the entire panel are more consistent. Thus, by the neutralization of both the fourth duration and the second duration, it can realize making the brightnesses of the images at the upper side and the lower side of the liquid crystal display panel more uniform to promote the display effect. Similarly, as the pixel capacitors Clc leak in the first duration, the third duration can similarly compensate the leakage in the first duration to realize making the brightness of the liquid crystal display panel more uniform.

Because the pixel capacitors Clc of the same column have the same polarity in the same duration, and the first polarity and the second polarity are opposite, and the second direction and the first direction are opposite, the brightnesses of the liquid crystal display panel in the third duration and in the fourth duration can compensate the brightnesses of the liquid crystal display panel in the first duration and in the second duration, which is beneficial to make the brightness of the entire liquid crystal display panel more even and promote the display effect of the images.

In this embodiment, the first duration, the second duration, the third duration and the fourth duration construct one drive cycle of the liquid crystal display panel. Accordingly, the gate driver 110 and the source driver 120 of the liquid crystal display panel cyclically perform the corresponding operations according to the first duration, the second duration, the third duration and the fourth duration.

In this embodiment, the first duration, the second duration, the third duration and the fourth duration are arranged in time sequence. Namely, the first duration is before the second duration, and the second duration is before the third duration, and the third duration is before the fourth duration, and the fourth duration is at the end. Certainly, the present invention is not limited thereto. In other embodiments of the present invention, it can be illustrated that the third duration, the fourth duration, the first duration and the second duration are arranged in time sequence.

Figure 3:
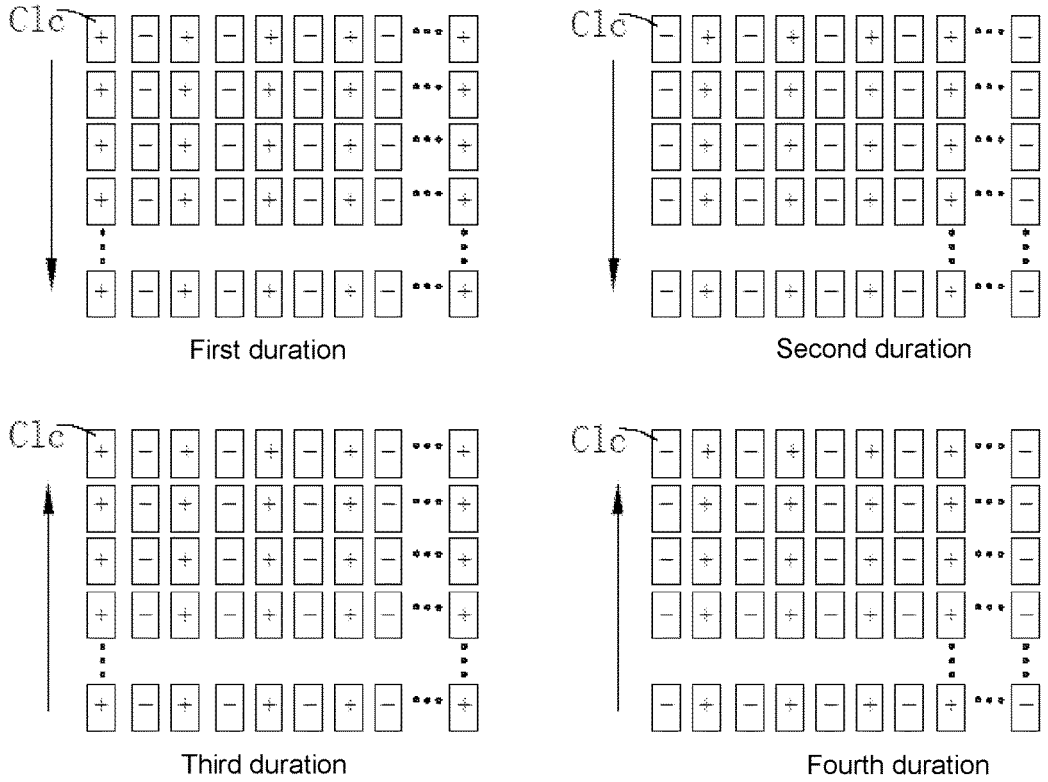
FIG. 3 is a polarity diagram of pixel capacitors in the first duration to the fourth duration according to one embodiment of the present invention.

In this embodiment, the first polarities in the different columns may be different. For instance, referring to FIG. 3, the first polarity of the pixel capacitors Clc of the first column is positive in the first duration, and the first polarity of the pixel capacitors Clc of the second column is negative, and the first polarity of the pixel capacitors Clc of the third column is positive, and the first polarity of the pixel capacitors Clc of the fourth column is negative, . . . , and the first polarity of the pixel capacitors Clc of the Mth column is positive, and similarly, the second polarities in the different columns may be different, too. Besides, in other embodiments of the present invention, as the polarity inversion is frame inversion, the first polarity is a positive, and the second polarity is negative. For instance, the polarity of all the pixel capacitors is positive in the first duration, and the polarity of all the pixel capacitors is negative in the second duration. Certainly, the first polarity also can be a negative polarity, and the second polarity can be a positive polarity. In this embodiment, the positive polarity and the negative polarity use the voltage of the common electrode of liquid crystal capacitor to be the reference voltage. Namely, as the voltage of the pixel electrode of the liquid crystal capacitor is larger than the voltage of the common electrode, the liquid crystal capacitor or the pixel electrode has a positive polarity, and as the voltage of the pixel electrode of the liquid crystal capacitor is smaller than the voltage of the common electrode, the liquid crystal capacitor or the pixel electrode has a negative polarity.

Figure 4:
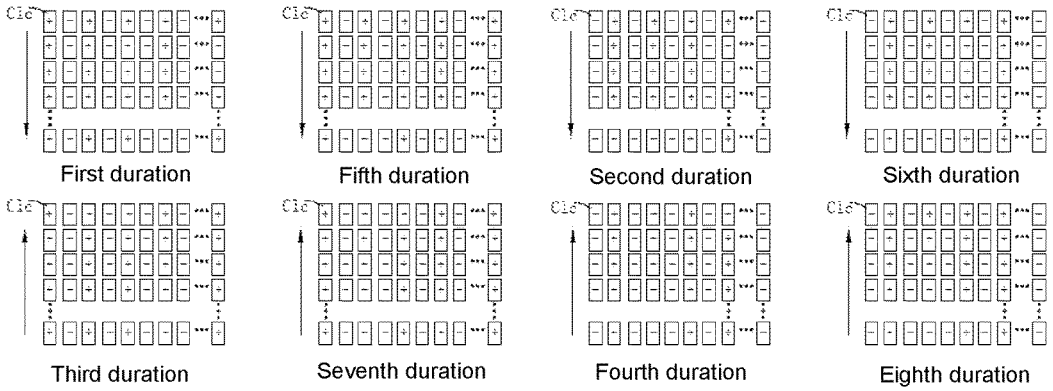
FIG. 4 is a polarity diagram of pixel capacitors in the first duration to the eighth duration according to another embodiment of the present invention.

Besides, in other embodiments of the present invention, a fifth duration is after the first duration, and in the fifth duration, the gate driver and the source driver perform the same operation according to the first duration, namely, the gate driver inputs an activation voltage to the scan lines line by line from a first direction in the fifth duration, and the source driver inputs the pixel voltage to the data lines to charge the pixel capacitors, and the polarity of the pixel voltage in the fifth duration is the same as the polarity of the pixel voltage in the first duration; a sixth duration is after the second duration, and in the sixth duration, the gate driver and the source driver perform the same operation according to the second duration; a seventh duration is after the third duration, and in the seventh duration, the gate driver and the source driver perform the same operation according to the third duration; an eighth duration is after the fourth duration, and in the eighth duration, the gate driver and the source driver perform the same operation according to the fourth duration. Here, referring to FIG. 4, the arrangement time sequence of the first duration to the eighth duration can be: a sequence of the first duration, the second duration, the fifth duration, the sixth duration, the third duration, the fourth duration, the seventh duration and the eighth duration, or can be a sequence of the first duration, the fifth duration, the second duration, the sixth duration, the third duration, the seventh duration, the fourth duration and the eighth duration. The first duration to the eighth duration construct one drive cycle of the liquid crystal display panel.

Besides, in other embodiments of the present invention, 2k durations are after the second duration, and 2j durations are after the fourth duration, and in two adjacent durations of the 2k durations, the gate driver and the source driver perform the same operation according to the first duration and the second duration, and in two adjacent durations of the 2j durations, the gate driver and the source driver perform the same operation according to the third duration and the fourth duration, wherein k and j are equal, and k and j are positive integers, and for instance, k=j=2, k=j=3, k=j=4, k=j=5, k=j=6, k=j=8, k=j=10. The first duration, the second duration, the 2k durations, the third duration, the fourth duration and the 2j durations construct one drive cycle of the liquid crystal display panel.

Significantly, each of the embodiments in the specification is described in a progressive manner, and each embodiment focuses on the differences from other embodiments, and the same or similar parts among the various embodiments can be referred to one another. For the embodiment of the device, it is basically similar with the embodiment of method, so the description is simpler, and the related parts can be referred to the description of the embodiment of method.

With the description of the foregoing embodiment, the present invention has advantages below:

Because the pixel capacitors of the same column have the same polarity in the same duration, and the first polarity and the second polarity are opposite, and the second direction and the first direction are opposite, the brightnesses of the liquid crystal display panel in the third duration and in the fourth duration can compensate the brightnesses of the liquid crystal display panel in the first duration and in the second duration, which is beneficial to make the brightness of the entire liquid crystal display panel more even and promote the display effect of the images.

Above are embodiments of the present invention, which does not limit the scope of the present invention. Any equivalent amendments within the spirit and principles of the embodiment described above should be covered by the protected scope of the invention.

What is claimed is:

1. A driving method of a liquid crystal display panel, and the liquid crystal display panel comprising a gate driver, N scan lines, a source driver, M data lines, a plurality of pixel capacitors, wherein N, M≥2, wherein the driving method comprises:

the gate driver inputting an activation voltage to the scan lines line by line from a first direction in a first duration, and the source driver inputting a pixel voltage of a first polarity to the data lines to charge the pixel capacitors;

the gate driver inputting an activation voltage to the scan lines line by line from the first direction in a second duration, and the source driver inputting a pixel voltage of a second polarity to the data lines to charge the pixel capacitors;

the gate driver inputting an activation voltage to the scan lines line by line from a second direction in a third duration, and the source driver inputting the pixel voltage of the first polarity to the data lines to charge the pixel capacitors;

the gate driver inputting an activation voltage to the scan lines line by line from the second direction in a fourth duration, and the source driver inputting the pixel voltage of the second polarity to the data lines to charge the pixel capacitors; wherein the pixel capacitors of the same column have the same polarity in the same duration, and the first polarity and the second polarity are opposite, and the second direction and the first direction are opposite.

2. The driving method of the liquid crystal display panel according to claim 1, wherein the first duration, the second duration, the third duration and the fourth duration construct one drive cycle of the liquid crystal display panel.

3. The driving method of the liquid crystal display panel according to claim 2, wherein the first duration, the second duration, the third duration and the fourth duration are arranged in time sequence; or the third duration, the fourth duration, the first duration and the second duration are arranged in time sequence.

4. The driving method of the liquid crystal display panel according to claim 1, wherein a fifth duration is after the first duration, and in the fifth duration, the gate driver and the source driver perform the same operation according to the first duration; a sixth duration is after the second duration, and in the sixth duration, the gate driver and the source driver perform the same operation according to the second duration; a seventh duration is after the third duration, and in the seventh duration, the gate driver and the source driver perform the same operation according to the third duration; an eighth duration is after the fourth duration, and in the eighth duration, the gate driver and the source driver perform the same operation according to the fourth duration.

5. The driving method of the liquid crystal display panel according to claim 4, wherein the first duration to the eighth duration construct one drive cycle of the liquid crystal display panel.

6. The driving method of the liquid crystal display panel according to claim 1, wherein 2k durations are after the second duration, and 2j durations are after the fourth duration, and in two adjacent durations of the 2k durations, the gate driver and the source driver perform the same operation according to the first duration and the second duration, and in two adjacent durations of the 2j durations, the gate driver and the source driver perform the same operation according to the third duration and the fourth duration, wherein k and j are equal, and k and j are positive integers.

7. The driving method of the liquid crystal display panel according to claim 1, wherein the first duration, the second duration, the third duration and the fourth duration individually are one frame.

8. The driving method of the liquid crystal display panel according to claim 1, wherein the first direction is a direction from the top to the bottom, and the second direction is a direction from the bottom to the top; or, the first direction is a direction from the bottom to the top, and the second direction is a direction from the top to the bottom.

9. The driving method of the liquid crystal display panel according to claim 1, wherein the first polarity is a positive polarity, and the second polarity is a negative polarity; or, the first polarity is a negative polarity, and the second polarity is a positive polarity.

10. The driving method of the liquid crystal display panel according to claim 1, wherein a polarity inversion of the pixel capacitors is a row inversion or a frame inversion.

* * * * *